US006603941B2

(12) United States Patent
Watanabe et al.

(10) Patent No.: US 6,603,941 B2
(45) Date of Patent: Aug. 5, 2003

(54) IMAGE FORMING APPARATUS INCLUDING FIRST AND SECOND CHARGE-APPLYING DEVICES DISPOSED BETWEEN DEVELOPER TRANSFER AND CHARGING POSITIONS ON AN IMAGE BEARING BODY

(75) Inventors: Yasunari Watanabe, Shizuoka (JP); Motoki Adachi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/957,249

(22) Filed: Sep. 21, 2001

(65) Prior Publication Data

US 2002/0057925 A1 May 16, 2002

(30) Foreign Application Priority Data

Sep. 25, 2000 (JP) ..... 2000-291026

(51) Int. Cl.[7] ..... G03G 21/00
(52) U.S. Cl. ..... 399/129; 399/150
(58) Field of Search ..... 399/149, 148, 399/150, 129

(56) References Cited

U.S. PATENT DOCUMENTS 5,066,982 A * 11/1991 Hosoya et al. ..... 399/150
5,196,892 A 3/1993 Mitsuaki
5,323,215 A * 6/1994 Ohtaka et al. ..... 399/150
5,751,405 A * 5/1998 Aita et al. ..... 399/150
5,784,673 A * 7/1998 Terada et al. ..... 399/149
5,832,336 A * 11/1998 Kawasaki et al. ..... 399/149
5,970,285 A 10/1999 Ito et al. ..... 399/149
6,006,055 A * 12/1999 Tadashi ..... 399/148
6,345,162 B1 * 2/2002 Ozawa et al. ..... 399/149
6,421,512 B2 * 7/2002 Watanabe et al. ..... 399/149
6,442,362 B2 * 8/2002 Hirabayashi et al. ..... 399/129

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes an image bearing body, a charging device for charging the image bearing body, a developing device for forming a developer image by developing an electrostatic image formed on the image bearing body, a transferring device for transferring the developer image to an image-receiving member, and first and second charge-applying devices. The first charge-applying device is provided at a downstream side of the transferring device and at an upstream side of the charging device in a moving direction of the image bearing body, for charging a residual developer remaining on the image bearing body after a transfer effected by the transferring device to a polarity opposite to a normal charging polarity of the developer. The second charge-applying device is provided at a downstream side of the first charge-applying device and at the upstream side of the charging device in the moving direction of the image bearing body, for charging the residual developer charged by the first charge-applying device to a same polarity as the normal charging polarity of the developer, wherein the charging device applies a charge to the residual developer charged by the second charge-applying device.

12 Claims, 3 Drawing Sheets

IMAGE FORMING APPARATUS INCLUDING FIRST AND SECOND CHARGE-APPLYING DEVICES DISPOSED BETWEEN DEVELOPER TRANSFER AND CHARGING POSITIONS ON AN IMAGE BEARING BODY

BACKGROUND OF THE INVENTION

1. Field of the Invention

The present invention relates to an image forming apparatus having charging means for charging an image bearing body or image bearing body. It is preferred that the present invention is applied to a cleanerless image forming apparatus capable of removing and recovering developer (toner) remaining on the image bearing body after the transfer process so that the recovered developer will be recycled by a developing device in the process of simultaneous development and cleaning without the need for a cleaning device.

2. Related Background Art

A conventional transfer type image forming apparatus, such as a copier, a printer and a facsimile, using a transfer type electrophotographic method is constituted of a photosensitive body, a charging device (charging process), an exposing device (exposing process), a developing device (developing process), a transfer device (transfer process), a cleaning device (cleaning process), a fixing device (fixing process), and so on. The photosensitive body is an image bearing body or image bearing body typically formed in the shape of a rotary drum. The charging device (charging process) statically charges the surface of the photosensitive body uniformly to predetermined polarity and potential. The exposing device (exposing process) writes information for forming an electrostatic latent image on the charged surface of the photosensitive body. The developing device (developing process) develops the electrostatic latent image formed on the photosensitive body with toner as developer to make the latent image visible. The transfer device (transfer process) transfers the toner image from the surface of the photosensitive body to a transfer material such as a paper sheet. The cleaning device (cleaning process) cleans the surface of the photosensitive body by removing toner slightly remaining on the photosensitive body after the transfer process. The fixing device (fixing process) fixes the toner image on the transfer material. In this arrangement, the photosensitive body is repeatedly used in the above-mentioned electrophotographic processes (charging, exposing, developing, transfer and cleaning) to form images.

The toner remaining on the photosensitive body after the transfer process is removed by the cleaning device from the surface of the photosensitive body and stored in the cleaning device as waste toner, but it is desirable not to create such waste toner from environmental protection and resource saving standpoints.

Therefore, there have been provided image forming apparatuses capable of returning, to the developing device, residual toner after transfer, that is, waste toner collected by the cleaning device so that the collected toner will be recycled.

Cleanerless image forming apparatuses have also been provided, in which the toner remaining on the photosensitive body after the transfer process is removed from the photosensitive body and recovered into the developing device in the process of "simultaneous development and cleaning" so that the recovered toner will be recycled by the developing device.

In the process of simultaneous development and cleaning, the toner remaining on the photosensitive body after transfer is recovered into the developing device for subsequent cycles of development. In other words, residual toner existing on a surface portion (non-image portion), not to be developed with toner, of the photosensitive body is recovered into the developing device by applying a bias for eliminating developing fog in the process of developing an electrostatic latent image for the next cycle of electrophotographic processes after continuously charging the photosensitive body, exposing the same to form the next electrostatic latent image. The bias Vback for eliminating developing fog denotes a difference in potential between voltage applied to the developing device and surface potential of the photosensitive body. The use of this process allows the toner remaining after transfer to be recovered into the developing device so that the recovered toner will be recycled for subsequent cycles of development of electrostatic latent images. Therefore, waste toner is eliminated, and hence troublesome maintenance work can be reduced. Further, since this type of image forming apparatus is cleanerless, it also has the advantage of reducing the overall apparatus size.

a) The above-mentioned type of cleanerless image forming apparatus removes the residual toner after the transfer process from the photosensitive body and recovers the removed toner into the developing device in the process of simultaneous development and cleaning so that the recovered toner will be recycled, but it has the following drawbacks. Suppose that the cleanerless image forming apparatus uses a contact type charging device which comes in contact with the photosensitive body to statically charge the surface of the photosensitive body. In this case, when the toner remaining on the photosensitive body after transfer passes through a charging portion as a contact nip portion between the photosensitive body and the contact charging device, some of the residual toner, especially toner that is charged to an opposite polarity to a normal polarity, tend to stick to the contact charging device, that is, to contaminate the contact charging device with toner inadmissibly, failing to charge properly.

Toner as developer naturally contains toner particles of the opposite or reverse polarity to the normal charging polarity, though they are limited in quantity. Even the toner particles charged to the normal polarity may reverse its polarity under the influence of a transfer bias or peeling discharge, or may be statically erased to reduce its charging amount.

Thus, the toner particles of the normal polarity, the toner particles of the reverse polarity, and the toner particles having a small charging amount are mixed up in the residual toner after transfer. Of all the mixed-up toner particles, the reversely charged toner particles and the toner particles having a small charging amount tend to stick to the contact charging device when passing through the contact nip portion in which the contact charging device comes in contact with the photosensitive body.

b) The following conditions are required for the developing device to remove and recover the toner remaining on the photosensitive body after transfer in the process of simultaneous development and cleaning. One condition is that the toner remaining on the photosensitive body after transfer and carried to the developing portion after passing through the charging portion must be statically charged to the normal polarity. The other condition is that an adequate charging amount of the toner to enable the developing device to properly develop the electrostatic latent image on the photosensitive body is needed. The reversely charged toner or the toner inadequate in the charging amount may not be removed and recovered from the photosensitive body, resulting in the occurrence of an image defect.

c) The adhesion of toner to the contact charging device mentioned in the foregoing paragraph a) can be prevented by taking the following measures. In other words, the adhesion of toner can be prevented by toner-charging amount control means directing all the toner particles remaining on the photosensitive body after transfer to the normal polarity while making the charging amount uniform. Although the toner remaining on the photosensitive body after transfer is carried from the transfer portion to the charging portion in the form of a mixture of normally charged toner, reversely charged toner and toner having the small charging amount, the application of a normal-polarity charge to the residual toner directs the residual toner all to the normal polarity.

However, the residual toner applied with the normal-polarity charge by the toner charging amount control means for the purpose of preventing the toner adhesion to the contact charging device becomes too large in its charging amount to properly develop the electrostatic latent image on the photosensitive body. This makes it difficult for the developing device to remove and recover the residual toner in the process of simultaneous development and cleaning. In this case, the next image is superimposed on the toner remaining on the photosensitive body to cause the occurrence of an image defect.

In addition, recent demands for continuous printing of images with high print quality such as of photographic images accompanied by diverse user needs, and a multiple development system for color printing involve occurring a large amount of toner remaining after transfer at a time, further promoting the above-mentioned drawbacks.

SUMMARY OF THE INVENTION

It is an object of the present invention to provide an image forming apparatus capable of properly correcting the charging polarity and charging amount of developer remaining on an image bearing body.

It is another object of the present invention to provide an image forming apparatus capable of preventing the developer remaining on the image bearing body from causing the occurrence of defects in subsequent images.

It is still another object of the present invention to provide an image forming apparatus capable of preventing the developer remaining on the image bearing body from sticking to charging means.

It is yet another object of the present invention to provide an image forming apparatus capable of efficiently recovering the developer remaining on the image bearing body into developing means.

It is yet another object of the present invention to provide an image forming apparatus suitable for a cleanerless system.

Other objects and features of the present invention will become further apparent from reading the following detailed description of embodiments with reference to the accompanying drawings.

DESCRIPTION OF THE PREFERRED EMBODIMENTS (First Embodiment)

Hereinbelow, an image forming apparatus (image recording apparatus) according to an embodiment of the present invention will be described.

Figure 1:
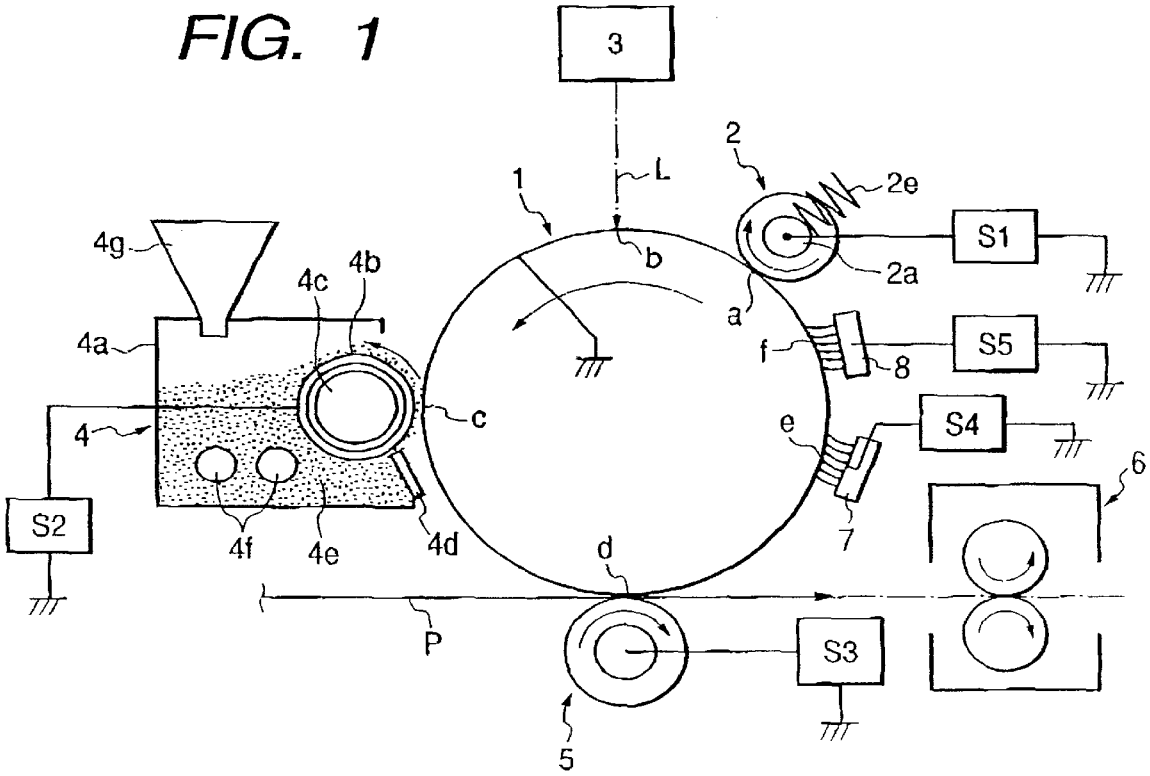
FIG. 1 is a schematic diagram of an image forming apparatus according to an embodiment of the present invention.

FIG. 1 is a schematic diagram illustrating an exemplary image forming apparatus according to the present invention. The image forming apparatus in this embodiment is a cleanerless laser beam printer, which uses transfer type electrophotographic processes employing contact charging system and reverse developing system. Further, the laser beam printer can cope with up to A3-size paper.

(1) Schematic General Structure of the Printer a) Image Bearing Body

The reference numeral 1 designates a rotary drum type electrophotographic photosensitive body as an image bearing body (hereinbelow, referred to as the photosensitive drum). The photosensitive drum 1 is a negatively charged organic photoconductive body (OPC) whose outside diameter is 50 mm. The photosensitive drum 1 is driven to rotate about its central axis in the counterclockwise direction shown by the arrow at a process speed (peripheral velocity) of 100 mm/sec.

Figure 2:
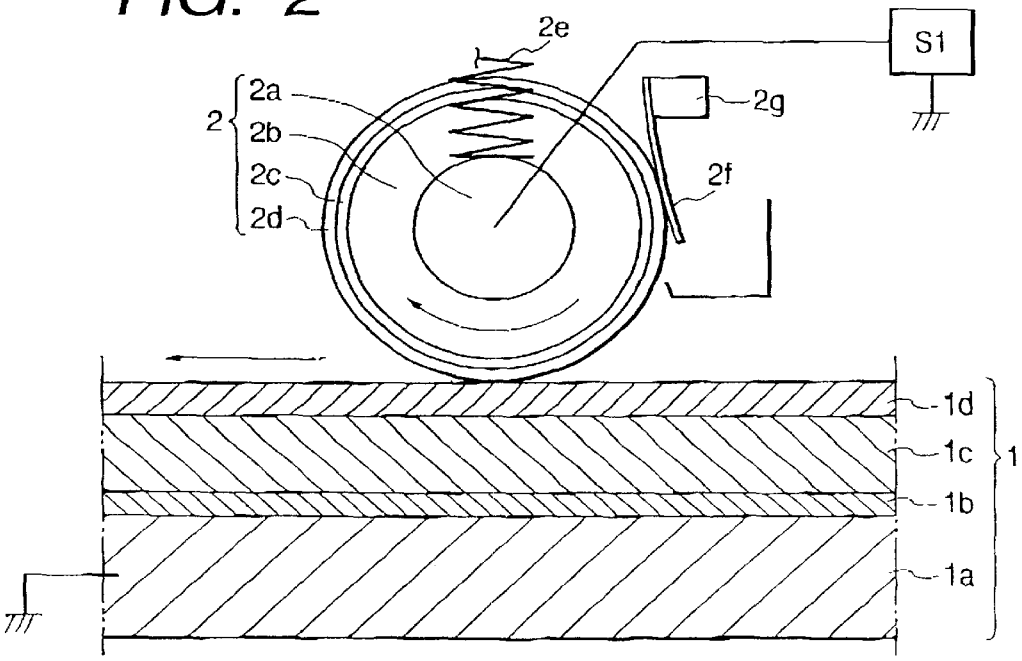
FIG. 2 is a schematic diagram illustrating the layer structure of a photosensitive drum and a charging roller.

As shown in a schematic diagram of the layer structure of FIG. 2, the photosensitive drum 1 is made up by coating three layers of a primer layer 1*b*, a photoconductive-charge generating layer 1*c* and a charge transporting layer 1*d* in this order on the surface of an aluminum cylinder (conductive drum base) 1*a*. The primer layer 1*b* suppresses interference of light and improves the adhesion properties to the upper layer.

b) Charging Means

The reference numeral 2 designates a contact-charging device (contact charger) as charging means for uniformly charging the circumferential surface of the photosensitive drum 1. In the embodiment, the contact-charging device is a charging roller (roller charging device).

The charging roller 2 is rotatably retained by bearing members, not shown, at both ends of a core metal 2*a* The charging roller 2 is forced by a pressure spring 2*e* in the direction of the photosensitive drum 1 and brought into contact with the surface of the photosensitive drum 1 by application of predetermined pressure. Thus the charging roller 2 is rotated as the photosensitive drum 1 rotates. A pressure-contact portion between the photosensitive drum 1 and the charging roller 2 is a charging portion (charging nip portion) a.

The core metal 2*a* of the charging roller 2 is applied with a charging bias voltage determined according to predetermined conditions so that the rotating circumferential surface of the photosensitive drum 1 contacting the charging roller 2 will be contact-charged to predetermined polarity and potential. In the embodiment, the charging bias voltage applied to the charging roller 2 is an oscillating voltage superimposing a DC voltage (Vdc) and an AC voltage (Vac).

TO be more specific, the oscillating voltage is made up by superimposing the following:

DC voltage: −500 volts

AC voltage: A sine wave oscillating at a frequency f of 1000 Hz with a 1400-volt peak-to-peak voltage Vpp. The circumferential surface of the photosensitive drum 1 is contact-charged uniformly to −500 volts (dark-portion potential Vd).

The charging roller 2 is 320 mm in length in the longitudinal direction, and is made up by laminating three layers of a lower layer 2*b*, an intermediate layer 2*c* and surface layer 2*d* in this order from the bottom The lower layer 2*b* is a layer of foamed sponge for reducing charging noise. The intermediate layer 2*c* is a conductive layer for obtaining uniform resistance of the entire charging roller 2 The surface layer 2*d* is a protective layer provided for preventing the occurrence of a leak even if the photosensitive drum 1 has a defect such as a pinhole on its surface.

To be more specific, the specifications of the charging roller 2 is as follows:

Core metal 2*a*: Stainless round bar 6 mm in diameter

Lower layer 2*b*: Carbon-dispersed, foamed EPDM with a specific gravity of 0.5 g/cm$^3$, a volume resistance of $10^2$ to $10^9$ Ωcm, a layer thickness of 3.0 mm, and a length of 320 mm Intermediate layer 2*c*: Carbon-dispersed MBR rubber with a volume resistance of $10^2$ to $10^6$ Ωcm and a layer thickness of 700 μm Surface layer 2*d*: Toresin resin of a fluorine compound, in which tin oxide and carbon are dispersed, with a volume resistance of $10^7$ to $10^{10}$ Ωcm, a surface roughness (JIS-standard averaging surface roughness Ra on a scale of 10) of 1.5 μm, and a layer thickness of 10 μm In FIG. 2, the reference numeral 2*f* designates a charging-roller cleaning member that is a flexible cleaning film in the embodiment. The cleaning film 2*f* is arranged in parallel with the charging roller 2 along the longitudinal direction of the charging roller 2, and fixed to one end of a support member 2*g* reciprocating a fixed stroke along the longitudinal direction of the charging roller 2. The cleaning film 2*f* forms a contact nip with the charging roller 2 on its surface of a free end side The support member 2*g* is driven by a driving motor of the printer through a series of gears to reciprocate the fixed stroke along the longitudinal direction of the charging roller 2, so that the cleaning film 2*f* scrapes along the surface layer 2*d* of the charging roller 2, thereby removing contaminants (toner fine powder, external additives and the like) sticking to the surface layer 2*d* of the charging roller 2. As shown in FIG. 2, the free end of the cleaning film 2*f* is separated from the surface of the charging roller 2. It is preferred that the cleaning film 2*f* has a frictionally charging polarity for frictionally charging or triboelectrifying toner sticking to the charging roller 2 to the normal polarity, which allows the toner to be returned from the charging roller 2 to the photosensitive drum 1.

c) Information Writing Means

The reference numeral 3 designates an exposing device as information writing means for forming an electrostatic latent image on the surface of the photosensitive drum 1 whose surface has been charged. In the embodiment, the exposing device 3 is a laser beam scanner using semiconductor laser The exposing device 3 outputs a laser beam modulated in response to an image signal sent from a host apparatus such as image reading apparatus, not shown, to the printer side to perform laser scanning and exposure L (image exposure) in an exposing position b on the uniformly charged surface of the photosensitive drum 1. The laser scanning and exposure L reduces the potential of laser-beam irradiated portions over the surface of the photosensitive drum 1 to form an electrostatic latent image corresponding to the image information sequentially over the surface of the photosensitive drum 1.

d) Developing Means

The reference numeral 4 designates a developing device (developing unit) as developing means for supplying developer (toner) to the electrostatic latent image on the photosensitive drum 1 to make the electrostatic latent image visible. In the embodiment, the developing device 4 is a reverse developing device using a magnetic brush developing process with two component developer.

The reference numerals 4*a* and 4*b* designate a developer container and a nonmagnetic developing sleeve, respectively. The developing sleeve 4*b* is rotatably provided in the developer container 4*a* while exposing part of its outer surface to the outside. A magnet roller 4*c* is inserted in the developing sleeve 4*b* and fixed not to rotate. The reference numeral 4*d* designates a developer coating blade. Two component developer 4*e* is contained in the developer container 4*a*, and a developer stirring member 4*f* is arranged on the bottom side inside the developer container 4*a*. A toner hopper 4*g* contains toner to be replenished.

The two component developer 4*e* in the developer container 4*a* is a mixture of toner and magnetic carrier, which is stirred by the developer stirring member 4*f*. In the embodiment, the resistance of the magnetic carrier is about $10^{13}$ Ωcm and the particle size is about 40 μm. The toner is frictionally rubbed on the magnetic carrier and triboelectrified to the negative polarity.

The developing sleeve 4*b* is arranged opposite to and in close proximity to the photosensitive drum 1 with maintaining the 350 μm closest distance (s-Dgap) to the photosensitive drum 1. The portion in which the photosensitive drum 1 faces the developing sleeve 4*a* is a developing portion c. The developing sleeve 4*b* is driven to rotate in the direction opposite to the direction of rotation of the photosensitive drum 1 in the developing portion c. The two component developer 4*e* in the developer container 4*a* is partially attracted to the outer surface of the developing sleeve 4*b* by a magnetic force of the magnet roller 4*c* in the sleeve, and absorbed and carried as a magnetic brush layer. The magnetic brush layer is rotationally carried as the sleeve rotates. Then the magnetic brush layer is regulated by the developer coating blade 4*d* to a predetermined-thick thin layer so that the magnetic brush layer will rub to a proper extent against the surface of the photosensitive drum 1 in contact therewith in the developing portion c. A predetermined developing bias is applied from a power source S2 to the developing sleeve 4*b*. In the embodiment, the developing bias voltage applied to the developing sleeve 4*b* is an oscillating voltage superimposing a DC voltage (Vdc) and an AC voltage (Vac).

TO be more specific, the oscillating voltage is made up by superimposing the following:

DC voltage: −350 volts

AC voltage: 1600 volts

Thus the thin layer of the magnetic brush is coated on the surface of the developing sleeve 4*b*. The developing bias creates an electric field to allow the toner component in the developer carried to the developing portion c to stick to selected portions corresponding to the electrostatic latent image over the photosensitive drum 1. Thus the electrostatic latent image is developed to form a toner image. In the embodiment, the toner sticks to the exposed light portions over the surface of the photosensitive drum 1, thus reversely developing the electrostatic latent image.

The charging amount of the toner developed on the photosensitive drum 1 is −25 μC/g. At this time, the normally charged polarity of the toner is negative.

After passing through the developing portion c, the developer thin layer on the developing sleeve 4*b* is continuously rotated as the developing sleeve 4*b* rotates, and returned to the developer accumulated portion in the developer container 4*a*.

The density of toner contained in the two component developer 4*e* inside the developer container 4*a* is maintained to substantially within a predetermined fixed range. Therefore, the toner density of the two component developer 4*e* inside the developer container 4*a* can be sensed, for example, by an optical toner density sensor, not shown, to control the toner hopper 4*g* to be driven according to the sensed information for replenishing toner from the toner hopper to the two component developer 4*e* inside the developer container 4*a*. The toner replenished to the two component developer 4*e* is then stirred by the stirring member 4*f*.

e) Transferring Means/Fixing Means

The reference numeral 5 designates a transfer device. In the embodiment, the transfer device 5 is a transfer roller The transfer roller 5 is brought into contact with the photosensitive drum 1 by application of predetermined pressure. The pressure-contact nip portion forms a transfer portion d. A transfer material (transferred material, recording material) P as an image-receiving member is fed from a paper feed mechanism, not shown, to the transfer portion d at predetermined control timing.

The transfer material P fed to the transfer portion d is conveyed while being nipped or sandwiched between the photosensitive drum 1 and the transfer roller 5 as both rotate. At this time, a positive transfer bias opposite in polarity to the negative polarity as the normal charging polarity of toner, +2 kv in the embodiment, is applied from a power source S3 to the transfer roller 5. As a result, the toner image on the photosensitive drum 1 is electrostatically transferred sequentially to the surface of the transfer material P sandwiched and conveyed through the transfer portion d.

The transfer material P to which the toner image has been transferred through the transfer portion d is separated from the surface of the photosensitive drum 1 gradually as the photosensitive drum 1 rotates. Then the transfer material P is conveyed to a fixing device (e.g., heating roller fixing device) in which the toner image is fixed and printed out as an image formed material (print or copy).

(2) Cleanerless System and Toner-Charging Amount Control

The printer according to the embodiment is of the cleanerless type that is not equipped with any cleaning device exclusively used for removing the toner slightly remaining on the surface of the photosensitive drum 1 after the toner image has been transferred to the transfer material P. The toner remaining on the surface of the photosensitive drum 1 after transfer is carried to the developing portion c through the exposing portion b as the photosensitive drum 1 continues to rotate, and is effected with simultaneous development and cleaning (collected) by the developing device 4 in the process of simultaneous development and cleaning (in the cleanerless system). In other words, after the surface of the photosensitive drum 1 on which the toner remaining after transfer existed has been statically charged in the charging portion a and exposed in the exposing portion b to form the next electrostatic latent image, dark portions of the electrostatic latent image on the surface of the photosensitive drum 1 on which the residual toner remaining after the previous transfer process is recovered into the developing device 4 simultaneously with the development of light portions of the electrostatic latent image. Since the toner remaining on the surface of the photosensitive drum 1 passes through the exposing portion b, the exposing process is performed over the toner remaining after the previous transfer process, but the amount of the toner remaining after the previous transfer is so little that the exposing process is not affected by the residual toner very much.

However, as discussed above, reverse-polarity toner (reversely charged toner) and toner small in the charging amount are mixed in the toner remaining after the previous transfer. When passing through the charging portion a, the reversely charged toner and the toner having the small charging amount tend to stick to the charging roller 2, and hence contaminate the charging roller 2 with toner inadmissibly, failing to charge properly.

Further, the following conditions are required for the developing device 4 to effectively clean the toner remaining on the surface of the photosensitive drum 1 after the previous transfer simultaneously with the developing process. One condition is that the toner remaining on the photosensitive body 1 after the previous transfer and carried to the developing portion c must be statically charged to the normal polarity. The other condition is that an adequate charging amount of toner to enable the developing device 4 to properly develop the electrostatic latent image on the photosensitive drum 1 is needed. The reversely charged toner and the toner inadequate in the charging amount may not be removed from the photosensitive drum 1 and recovered into the developing device 4, resulting in the occurrence of an image defect.

In addition, a recent increase in demand for continuous printing of images with high print quality such as of photographic images accompanied by diverse user needs involves occurring a large amount of toner remaining after transfer at a time, further promoting the above-mentioned drawbacks.

To avoid the drawbacks, the embodiment is provided with first toner- (developer-) charging amount control means (first charge-applying means) 7 and second toner- (developer-) charging amount control means (second charge-applying means) 8 downstream from the transfer portion d and upstream from the charging portion a in the direction of rotation of the photosensitive drum 1 so that all the charged toner particles remaining after transfer will be directed to the negative polarity as the normal polarity.

In the embodiment, the first toner-charging amount control means 7 and the second toner-charging amount control means 8 are brush-shaped members having moderate conductivity; they are so arranged that the respective brush portions keep in contact with the surface of the photosensitive drum 1.

The first toner-charging amount control means 7 is applied with a positive voltage from a power source S4.

The second toner-charging amount control means 8 is applied with a negative voltage from a power source S5.

A contact portion e is a portion in which the first toner-charging amount control means 7 comes in contact with the surface of the photosensitive drum 1. Of all the toner particles remaining after transfer and different in polarity, the toner particles charged to zero or to the negative polarity are once sucked into the first toner-charging amount control means 7. However, since the amount of toner capable of being held by the first toner-charging amount control means 7 is limited, saturated toner gradually escapes from the first toner-charging amount control means 7 and sticks to the surface of the photosensitive drum 1. Although the toner sticking to the surface of the photosensitive drum 1 is carried as the photosensitive drum 1 rotates, the polarity of the toner becomes positive and the distribution of the toner is made uniform.

A contact portion f is a portion in which the second toner-charging amount control means 8 comes in contact with the surface of the photosensitive drum 1. When passing through the second toner-charging amount control means 8, all the charged toner particles remaining on the photosensitive drum 1 after transfer are directed to the negative polarity as the normal polarity. All the charged toner particles have been directed to the positive polarity through the first toner-charging amount control means 7, which is more effective in directing all the charged toner particles to the negative polarity. Since all the toner particles remaining after transfer are directed to the negative polarity as the normal polarity through the second toner-charging amount control means 8, which makes mirroring powers large enough to charge the surface of the photosensitive drum 1 properly even through the toner remaining after transfer. Thus the toner remaining after transfer is prevented from sticking to the charging roller 2.

Figure 3:
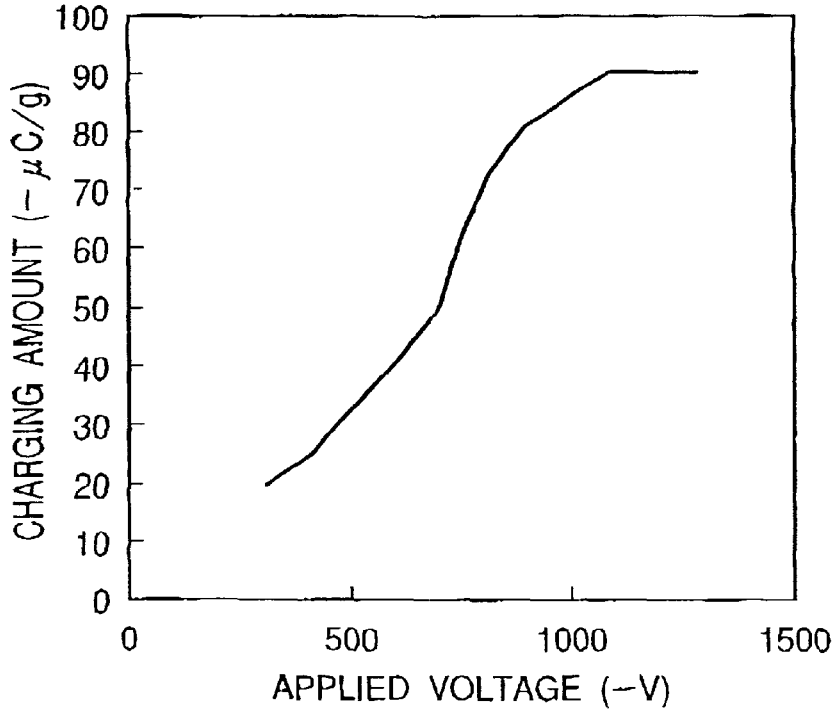
FIG. 3 is a graph showing the relationship between voltage applied to toner-charging amount control means and the charging amount of toner remaining after transfer.

FIG. 3 shows the relationship between voltage applied to the second toner-charging amount control means 8 and the charging amount of the toner after passing through the toner-charging amount control means.

Before reaching the second toner-charging amount control means 8, the toner remaining after transfer passes through the first toner-charging amount control means 7 and is already charged to the opposite polarity (positive) to the normal polarity (negative). Therefore, the toner after passing through the second toner-charging amount control means 8 is directed to the opposite polarity (positive) to the normal polarity unless the voltage is applied to the second toner-charging amount control means 8.

On the other hand, when the voltage is applied to the second toner-charging amount control means 8, the charging amount of-the toner after passing through the second toner-charging amount control means 8 increases and becomes saturated when the charging amount reaches a certain value or more. The toner used in the embodiment is saturated when the charging amount reaches −90 $\mu$C/g.

Figure 4:
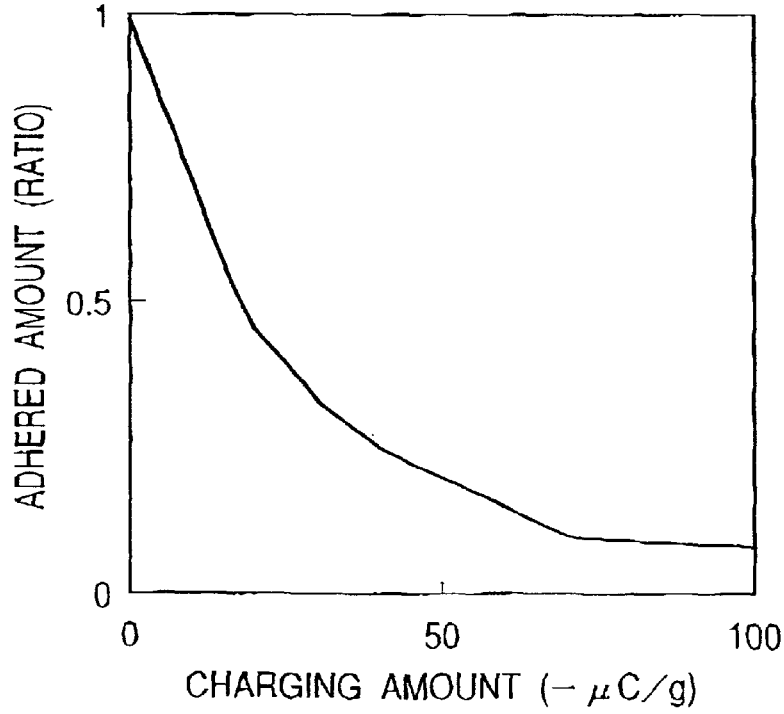
FIG. 4 is a graph showing the relationship between the charging amount of the toner remaining after transfer and the amount of toner adhesion to the charging roller.

Assuming that the amount of the toner remaining after transfer and before approaching the charging portion a is one, the relationship between the charging amount of the toner remaining after transfer and the amount of toner adhesion to the charging roller 2 is shown in a graph of FIG. 4. It is apparent from the graph that the amount of toner adhesion is reduced as the charging amount of the toner remaining after transfer increases. In this case, an image defect due to the adhesion of to the charging roller 2 of the toner remaining after transfer occurred when the charging amount of the toner remaining after transfer was −55 $\mu$C/g or less.

In the embodiment, a −800 volt voltage was applied to the second toner-charging amount control means 8, and the charging amount of the toner remaining after transfer and after passing through the second toner-charging amount control means 8 was −70 $\mu$C/g. It should be noted that since the toner remaining after transfer slightly sticks to the charging roller 2, the surface of the charging roller 2 is cleaned by the cleaning film 2*f*.

The following discussion describes recoverability of toner remaining after transfer in the developing process.

As discussed above, the developing device 4 is adopting a cleanerless system in which the toner remaining after transfer is cleaned simultaneously with the developing process. As also discussed above, the charging amount of the toner after developed on the photosensitive drum 1 is −25 $\mu$C/g in the embodiment. The following Table 1 shows the relationship between recoverability of toner remaining after transfer and the charging amount of the toner under varied developing conditions in the embodiment.

TABLE 1

| Charging amount ($\mu$c/g) | Collectabilily |
|---|---|
| −10.0 | Unacceptable |
| −12.5 | Good |
| −15.0 | Good |
| −30.0 | Good |
| −40.0 | Good |
| −45.0 | Good |
| −50.0 | Unacceptable |

The toner charging amount of the toner remaining on the photosensitive drum 1 after transfer and recovered into the developing device 4 needs optimizing.

However, the toner remaining after transfer is greatly charged to the negative polarity through the second toner-charging amount control means 8 in the above-mentioned manner to prevent the adhesion of toner to the charging roller 2. Therefore, it is advisable to electrostatically erase the toner remaining after transfer so that it can be recovered into the developing device 4.

Figure 5:
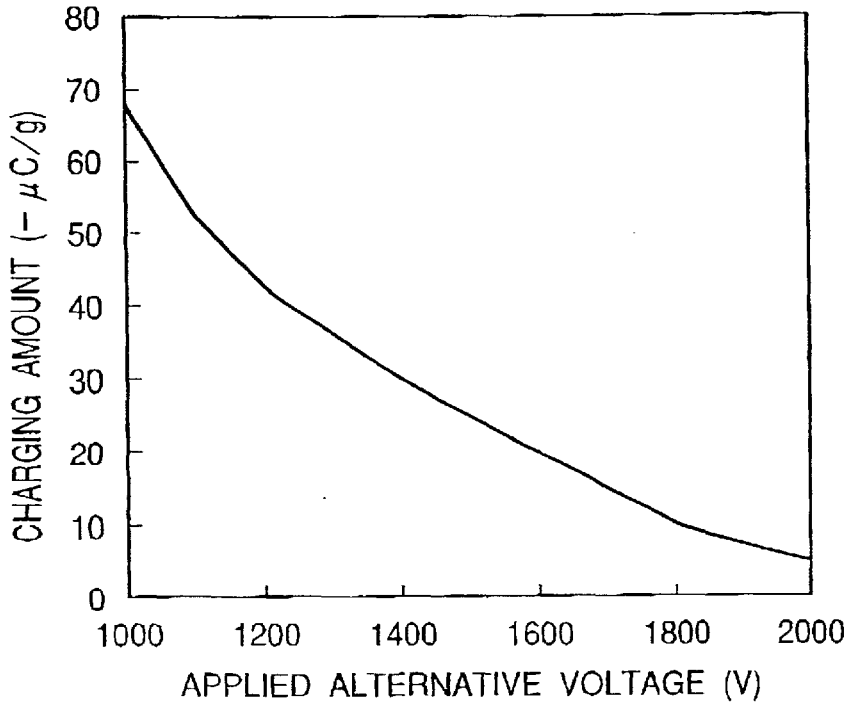
FIG. 5 is a graph showing the relationship between the charging amount of the toner after passing through the charging roller and applied AC voltage vpp.

FIG. 5 shows the relationship between the charging amount of the toner after the toner −70 $\mu$C/g in the charging amount on the photosensitive drum 1 passes through the charging roller 2 and the alternative voltage Vpp applied to the charging roller 2. It is apparent from FIG. 5 the residual toner is statically erased as the alternative voltage Vpp increases.

In other words, the charging roller 2 is applied with an alternative voltage Vpp (of 1400 volts at a frequency f of 1000 Hz) for allowing the charging roller 2 to charge the circumferential surface of the photosensitive drum 1, which alternately erase static electricity from the toner remaining after transfer. As a result, the toner after passing through the charging portion a becomes −30 $\mu$C/g in the charging amount. It is preferable to make the peak-to-peak value of the alternate voltage double the voltage of starting charging to the photosensitive drum 1 for proper electrification of the photosensitive drum 1 and proper static erase from the toner. Thus the toner remaining on the photosensitive drum 1 after transfer and not to be developed is recovered into the developing device 4 in the developing process on the above-mentioned grounds.

As discussed above, the first toner-charging amount control means 7 directs the polarity of triboelectrification of the toner, remaining on the photosensitive drum 1 after transfer and carried from the transfer portion d to the charging portion a, all to the positive polarity opposite to the normal polarity. Then the second toner-charging amount control means 8 directs the positively charged toner to the negative polarity as the normal polarity before the charging roller 2 charges the photosensitive drum 1, which prevents the toner remaining after transfer from sticking to the charging roller 2. The charging roller 2 charges the surface of the photosensitive drum 1 to predetermined potential. On the other hand, the second toner-charging amount control means 8 controls the charging amount of the toner remaining after transfer to be statically charged to the negative polarity as the normal polarity so that the developing device 4 can adequately develop the electrostatic latent image on the photosensitive drum 1. Consequently, the toner remaining after transfer can be recovered into the developing device 4, which can provide such an image forming apparatus as to prevent any charging failure and image defect while benefiting from the cleanerless system.

Figure 6:
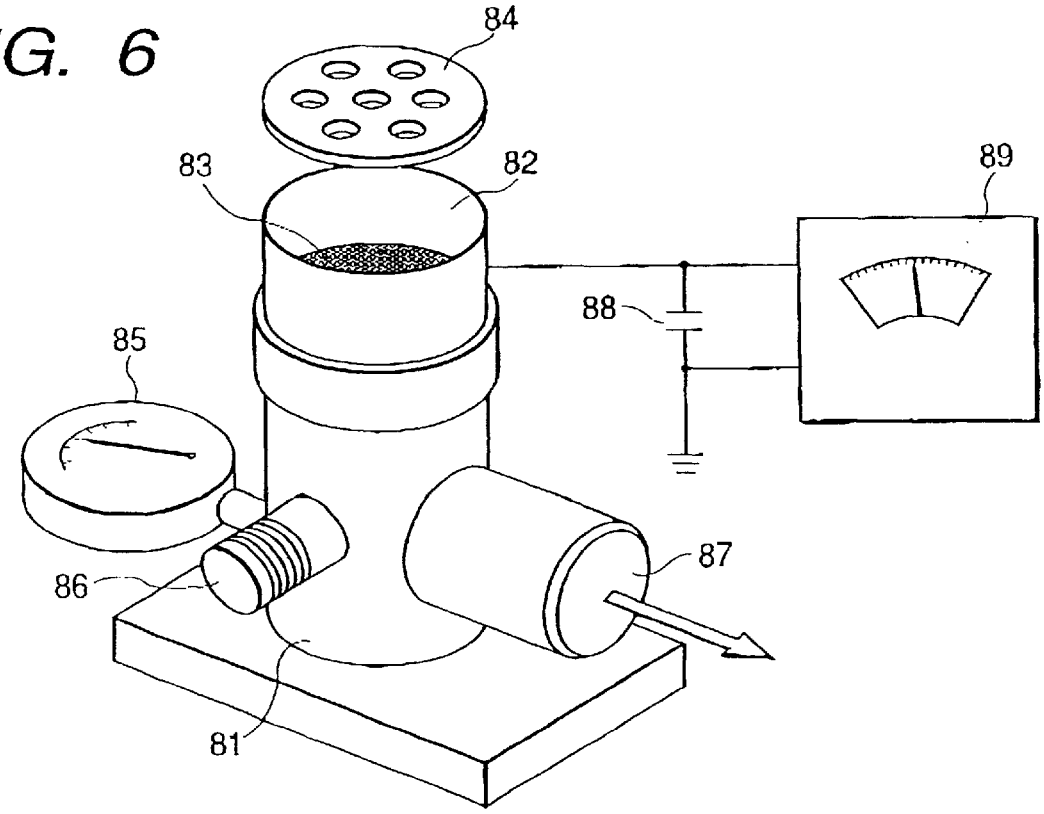
FIG. 6 is a schematic perspective view illustrating a triboelectrification amount-measuring device.

In the embodiment, the triboelectrification amount of the toner can be measured, for example, by the following process (blow-off process). FIG. 6 shows a schematic perspective view of an exemplary triboelectrification amount measuring device. As shown, developer (toner only or a mixture of toner and carrier) whose triboelectrification amount is to be measured is put in a metal measurement container 82 with a conductive screen 83 on the bottom, and then a metal top 84 is put on the container 82. After that, the measurement container 82 is weighed on the scales and the total weight is set as W1 (g).

Next, using a suction machine 81 (at least the portion that touches the measurement container 82 is made of insulating material), sucking is performed from a suction port 87 while adjusting an airflow control valve 86 so that a reduced pressure of 2450 is kept on a vacuum gage 85. Under this condition, sucking is continued adequately (for about one minute) to remove toner by suction At this time, potential given as a readout on an electrometer 89 is directly read to set the readout as V (volt), and the capacity of a capacitor 88 is set as C ($\mu$F). Further, the measurement container 82 at this time is weighed on the scales and the total weight is set as W2 (g). In this case, the amount T ($\mu$C/g) of the triboelectrification of the toner remaining in the developer is determined as the following equation:

$$T(\mu C/g)=C\times V/(W1-W2)$$

The charging amount of toner during development is thus measured by sampling the toner from the surface of the photosensitive drum 1 and putting the sampled toner in the measurement container 82.

The charging amount of the toner after transfer and after passing through the toner-charging amount control means 7 and 8 is also measured by sampling the toner from the surface of the photosensitive drum 1 and putting the sampled toner in the measurement container 82.

Further, the charging amount of the toner after transfer and after passing through the charging portion a is measured by sampling the toner from the surface of the photosensitive drum 1 and putting the sampled toner in the measurement container 82.

(Second Embodiment)

The structure of an image forming apparatus according to this embodiment is the same as that of the image forming apparatus according to the first embodiment.

The charging amount of developer (toner) varies with the environment, physical properties of the developer and the like. This embodiment illustrates a case where the charging amount of the toner on the photosensitive drum 1 after development under low-humidity environmental conditions is −35 $\mu$C/g larger than the value of −25 $\mu$C/g in the first embodiment.

The charging amount of the toner remaining after transfer and after passing through the second toner-charging amount control means 8 is −90 $\mu$C/g. Therefore, the toner remaining after transfer did not stick to the charging roller 2 in the charging portion a without any charging failure.

Further, the charging amount of the toner remaining after transfer and after passing through the charging portion a is −40 $\mu$C/g. Therefore, the toner remaining after transfer was properly recovered into the developing device 4.

(Other Embodiments)

1) The image bearing body may be the direct-injection electrostatic type that is provided with a charge injecting layer with a surface resistance of $10^9$ to $10^{14}$ Ω·cm. Even if the charge injecting layer is not employed, the charge transporting layer, for example, can display the same effect as the charge injecting layer as long as the resistance of the charge transporting layer is within the above-mentioned range. The image bearing body may also be an amorphous silicon photosensitive body whose surface layer has a volume resistance of about $10^{13}$ Ω·cm.

2) For the flexible contact charging member, other members-different in shape and material from the charging roller is usable such as a fur brush, felt and cloth. Various materials can also be combined to obtain proper elasticity, conductivity, surface properties and durability.

3) As the waveform of the alternating voltage component (AC component or voltage periodically varying its voltage value) applied to the contact charging member or the developing member, a sine wave, a rectangular wave or a triangular wave is usable accordingly. It may also be a rectangular wave formed by periodical power On/Off of the DC power source.

4) The image exposing means as the information writing means for writing image information to the charged surface of the photosensitive body as the image bearing body may be any means other than the laser scanning means as practiced in the above-mentioned embodiments. For example, digital exposing means using a solid-state light-emitting element array such as an LED array may be used. Analog image exposing means using a halogen lamp or fluorescent lamp as the original lighting source may also be used. Namely, the image exposing means may be of any type as long as it can form an electrostatic latent image corresponding to the image information.

5) Further, the image bearing body may be an electrostatic recording inductor. In this case, after the surface of the inductor is charged uniformly, the static electricity is selectively erased from the charged surface by statically erasing means such as a statically erasing needle or an electron gun to form the electrostatic latent image corresponding to the target image information.

6) Any toner developing process and means for developing the electrostatic latent image with toner can be selected. For example, either the reverse developing method or the normal developing method may be adopted.

The process of developing an electrostatic latent image is roughly divided into four developing approaches. The first approach to the process of developing an electrostatic latent image is to apply toner to the image bearing body in a noncontact state with the image bearing body (one-component noncontact development). In this process, the toner is carried to the image bearing body in the form of a coating on the developer carrying member such as a blade or sleeve in case of nonmagnetic toner, or by applying magnetic force of attraction to the developer carrying member in case of magnetic toner. The second approach to the process of developing an electrostatic latent image is to apply toner to the image bearing body in a contact state with the image bearing body (one-component contact development). The third approach to the process of developing an electrostatic latent image is to apply developer to the image bearing body in a contact state with the developer, where the developer is made up by mixing magnetic carrier with toner particles (two component developer) and carried by the magnetic force of attraction (two component contact development). The fourth approach to the process of developing an electrostatic latent image is to apply the above-mentioned developer to the image bearing body in a noncontact state with the developer (two component noncontact development).

7) The transferring means is not limited to the roller transfer system as practiced in the above-mentioned embodiments. For example, the present invention may adopt a blade transfer system, a belt transfer system or any other contact type transfer/charging system, or a noncontact type transfer/charging system using a corona charger.

8) The present invention is not limited to the formation of monochromatic or black-and-white images. It can also be applied to an image forming apparatus for forming multicolor or full-color images by using an intermediate transfer body such as a transfer drum or transfer belt for a multiple transfer process.

As described above and according to the present invention, there is a cleanerless image forming apparatus provided with the developing means for removing and recovering the developer remaining on the image bearing body after the transfer process (toner remaining after transfer) in the process of simultaneous development and cleaning so that the recovered developer will be recycled. The image forming apparatus is aimed at distributing the developer remaining after transfer uniformly over the surface of the image bearing body to control triboelectrification of the developer so as to benefit from the cleanerless system. To achieve the features, the image forming apparatus is constituted such that the developer-charging amount control means directs the polarity of triboelectrification of the developer remaining after transfer to the normal polarity, and the charging means optimizes the charging amount. In this arrangement, the image forming apparatus according to the present invention can display the following effects:

a) The developer-charging amount control means directs the polarity of triboelectrification of the developer remaining on the image bearing body after transfer and carried from the transfer portion to the charging portion to the normal polarity, which prevents the developer remaining after transfer from sticking to the charging means;

b) The charging means statically charges the surface of the image bearing body to predetermined potential while controlling the charging amount of the developer, remaining after transfer and all statically charged to the normal polarity, so that an adequate charging amount to enable the developing means to properly develop the electrostatic latent image on the image bearing body is controlled, which allows the developing means to efficiently recover the developer remaining after transfer; and c) The above-mentioned adequate charging amount of the developer remaining after transfer and controlled by the charging means is smaller than the absolute value of the charging amount processed by the developer-charging amount control means, which makes it possible to provide an image forming apparatus capable of preventing the occurrence of a charging failure or image defect and benefiting from the cleanerless system.

It should be noted that the present invention is not limited to the above-mentioned embodiments. It is to be understood that various modifications will occur to those skilled in the art without departing from the spirit of the invention.

What is claimed is:

1. An image forming apparatus comprising:

an image bearing body;

charging means for charging said image bearing body;

developing means for forming a developer image by developing, with developer, an electrostatic image formed on said image bearing body;

transferring means for transferring the developer image to an image-receiving member;

first charge-applying means, provided at a downstream side of said transferring means and at an upstream side of said charging means in a moving direction of said image bearing body, for charging a residual developer remaining on said image bearing body after a transfer effected by said transferring means to a polarity opposite to a normal charging polarity of the developer; and second charge-applying means, provided at a downstream side of said first charge-applying means and at the upstream side of said charging means in the moving direction of said image bearing body, for charging the residual developer charged by said first charge-applying means to a same polarity as the normal charging polarity of the developer;

wherein said charging means applies a charge to the residual developer charged by said second charge-applying means.

2. An image forming apparatus according to claim 1, wherein the charging polarity of the residual developer after the charge is applied by said charging means is the same polarity as the normal charging polarity of the developer.

3. An image forming apparatus according to claim 1, wherein the charging polarity of said charging means is the same polarity as the normal charging polarity of the developer.

4. An image forming apparatus according to claim 1, wherein said charging means applies the charge to the residual developer so that an absolute value of the charge of the residual developer charged by said second charge-applying means will be reduced.

5. An image forming apparatus according to claim 1, wherein said charging means is provided in contact with said image bearing body.

6. An image forming apparatus according to claim 5, wherein an oscillating voltage is applied to said charging means.

7. An image forming apparatus according to claim 4, wherein said charging means is provided in contact with said image bearing body and is applied with an oscillating voltage.

8. An image forming apparatus according to claim 5, wherein said charging means is in a shape of a roller.

9. An image forming apparatus according to claim 1 further comprising electrostatic image forming means for forming the electrostatic image on said image bearing body charged by said charging means.

10. An image forming apparatus according to claim 9, wherein said image bearing body is a photosensitive body, and said electrostatic image forming means is provided with exposing means for exposing said photosensitive body.

11. An image forming apparatus according to any one of claims 1 through 10, wherein said developing means is capable of collecting the residual developer from said image bearing body.

12. An image forming apparatus according to any one of claims 1 through 10, wherein said developing means is capable of collecting the residual developer from said image bearing body simultaneously with development.

* * * * *

UNITED STATES PATENT AND TRADEMARK OFFICE

CERTIFICATE OF CORRECTION

PATENT NO. : 6,603,941 B2
DATED : August 5, 2003
INVENTOR(S) : Yasunari Watanabe et al.

It is certified that error appears in the above-identified patent and that said Letters Patent is hereby corrected as shown below:

Title page,
Item [56], References Cited, U.S. PATENT DOCUMENTS,
"6,006,055 A *12/1999 Tadashi" should read
-- 6,006,055 A *12/1999 Furuya --.

Column 2,
Line 35, "tend" should read -- tends --.

Column 5,
Line 15, "roller 2" should read -- roller 2. --; and
Line 62, "laser" should read -- laser. --.

Column 6,
Line 55, "TO" should read -- to --.

Column 7,
Line 25, "roller" should read -- roller. --.

Column 9,
Line 41, "of-the" should read -- of the --.

Column 11,
Line 23, "suction" should read -- suction. --.

Column 12,
Line 13, "members-different" should read -- members different --.

Signed and Sealed this

Thirteenth Day of January, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,603,941 B2
DATED : August 5, 2003
INVENTOR(S) : Yasunari Watanabe et al.

It is certified that error appears in the above-identified patent and that said Letters Patent is hereby corrected as shown below:

Title page,
Item [56], References Cited, U.S. PATENT DOCUMENTS,
"6,006,055 A * 12/1999 Tadashi" should read -- 6,006,055 A * 12/1999 Furuya --.

Column 2,
Line 35, "tend" should read -- tends --.

Column 5,
Line 15, "roller 2" should read -- roller 2. --; and
Line 62, "laser" should read -- laser. --.

Column 6,
Line 55, "TO" should read -- to --.

Column 7,
Line 25, "roller" should read -- roller. --.

Column 9,
Line 41, "of-the" should read -- of the --.

Column 11,
Line 23, "suction" should read -- suction. --.

Column 12,
Line 13, "members-different" should read -- members different --.

Signed and Sealed this

Ninth Day of March, 2004

JON W. DUDAS
*Acting Director of the United States Patent and Trademark Office*